US005461846A

United States Patent [19]

Cormier et al.

[11] Patent Number: 5,461,846

[45] Date of Patent: Oct. 31, 1995

[54] HIGH SPEED BAG PACKAGING MACHINE

[75] Inventors: Roger Cormier, Buckingham; Robert Cormier; Jocelyn Riopel, both of Gatineau, all of Canada

[73] Assignee: Atelier D'usinage Cormier & Freres Inc., Gatineau, Canada

[21] Appl. No.: 81,694

[22] Filed: Jun. 25, 1993

[51] Int. Cl.[6] ..... B65B 43/14; C06F 5/00

[52] U.S. Cl. ..... 53/571; 53/385.1; 53/469; 53/570; 53/395

[58] Field of Search ..... 248/95, 100, 101; 53/385.1, 395.1, 467, 469, 473, 493, 570, 571, 576, 577

[56] References Cited

U.S. PATENT DOCUMENTS

| | | | |
|---|---|---|---|
| 3,465,499 | 9/1969 | Nelson et al. | 53/571 |
| 3,468,100 | 9/1969 | Rubel | 53/385.1 |
| 3,495,378 | 2/1970 | Kipers | 53/385.1 |

*Primary Examiner*—W. Donald Bray

[57] ABSTRACT

A bag filling machine for inserting multiple articles in a bag has multiple chutes to distribute the articles to compartments in a hopper. A trap door on the bottom of the hopper holds the bag to be filled open while the articles drop therein. Improvements enhance the speed of operation and reliability of this machine.

1 Claim, 7 Drawing Sheets

HIGH SPEED BAG PACKAGING MACHINE

FIELD OF THE INVENTION

This invention relates to an improved machine for delivering multiple articles to be deposited in a single container. In particular, it relates to improvements in a machine that deposits multiple pouches of a liquid, such as milk, in a carrying sack.

BACKGROUND TO THE INVENTION

In the early 1970's it became increasingly popular to market milk in plastic bags or pouches. Individually, these pouches would contain a quart or liter of milk for convenient house-hold dispensing. For market distribution, it was found desirable to sell multiple numbers of such pouches, preferably three, in a single outer bag or carrying sack. This second outer sack also reduces the risk that the inner pouches will be punctured, and if they are, serves to contain, at least partially, such leakage as may occur.

Lieberman U.S. Pat. No. 3,698,153 describes a very successful design for placing multiple pouches into a carrying sack. This design is now in broad use in North America.

Two important considerations in this field are speed and reliability. Speed is important for maximizing the output of a dairy in terms of the daily volume of milk shipped. The subject bagger places significant limits on production capacity because it accepts pouches linearly, and dispenses multiple pouch containing sacks downstream at a rate that is a proportionally reduced factor of the input speed of the pouches. Thus exiting sacks containing three pouches need merely be conveyed-away, and further processed, at one-third the incoming speed of the pouches.

Upstream from the bagger, milk can be fitted into pouches by multiple pouch-filling machines. With only one exit conveyor for a bagging station, it is apparent that the achievement of high speed at such bagging station is a critical objective.

Reliability is the second key factor in such an operation. If pouches or sacks break or get hung-up on conveyors, the entire line must be stopped. Unfortunately, experience has shown that as speed increases, reliability falls.

Existing pouch baggers can, with reasonable reliability, achieve packaging rates of about 100 pouches per minute. It is an object of this invention to increase this rate, without a significant loss in reliability.

The Lieberman machine receives pouches from an input conveyor, distributing them into a hopper with three sections. Adjustable chutes positioned between the two central sections consecutively direct pouches into each of the three sections or compartments. While this occurs, a trap door beneath the sections retains the pouches in position.

When all three compartments in the hopper are occupied, the trap door swings open. A series of plastic outer sacks or bags in a flattened state are hung next to the trap door. A flow of air from jets opens the top of the most proximate sack so that one of its upper edges lies in the path of the trap door as it swings open.

The opening of the trap door carries this upper first edge of the sack with it, exposing the opened sack as the pouches commence to fall therein.

The displaced edge of the sack is held open in known machines by the rear face of the trap door, held in a pinching-like manner against a contact or pinching plate that is supported on a frame. This prevents the free, upper edge of the sack from being carried immediately downwards by frictional drag arising from the descending pouches. When the pouches strike the bottom of the sack, their weight causes both of the upper edges of the sack to tear loose from their retaining means.

The filled sack then falls onto an exit conveyor for transport to the next station.

The pinching plate in known machines is sometimes loosely mounted to permit a slight vertical displacement, resisted by a spring. This freedom of movement has been found to reduce the incidence of premature release of the pinched edge. However, such failures are not uncommon with the existing design particularly when operated at higher speeds.

Air jets are used to initially open the top of the sack and move the free upper edge of the opening into the path of the trap door. It has been found that excessive airflow can, however, cause this edge to flutter, occasionally resulting in the failure of the trap door to engage with the free edge, and carry it to the pinching plate.

The flattened sacks are fed into the bagger by hanging them as a layered bundle on a pair of support rods that pass through a pair of holes formed in an upper, extended panel located as an extension to one of the upper ends of each sack. When the pouches fall into place the holes in this upper panel are torn open by the added weight, permitting the sack to fall.

Various systems exist for advancing the sacks along the rods as they are consumed. These include spring loaded arms that press against the sack. The Lieberman patent shows a plate with a handle hanging from an angled support shaft positioned above the mass of sacks. This plate exerts a constant force that serves to resist any tendency for the sacks to travel backwards, away from the trap door. No known system, however, provides a controlled pressure that varies with the number of sacks being advanced and is free of excess mechanical complexity and operates as effectively as that hereinafter described.

In existing machines the sacks containing bagged pouches are dropped directly onto a conveyor. This necessitates a clear gap sufficient for the weight of the pouches to tear the sacks loose from their support rods. The consequence is that a sack experiences a sharp, jerked acceleration when the weight of the pouches commences to tear the upper panel on the sack. This can cause uneven tearing and the consequent rotation of the sack into an inappropriate orientation when it becomes deposited on the conveyor. If the misalignment is serious, the production flow may have to be halted.

A means to reduce the incidence of such misalignments is desirable, and is accordingly an object of this invention.

A further failure of existing machines when run at the upper limit of their operational speed is that the first compartment of the hopper to be filled may become occupied by an entering pouch while the trap door is still in the course of closing (after release of the previous sack). This, on occasion, will prevent the trap door from closing. This problem exists only with respect to the first pouch to enter the hopper because the inflow of pouches is continuous, and the first pouch of the next series is following directly behind the last pouch of the previous series.

One solution is to increase the speed of closing of the trap door. However, this is noisy and stressful on components. The other solution of slowing down the infeed conveyor is also unsatisfactory.

As this phenomena places a limit on the rate of delivery of pouches to the hopper, an improvement to prevent interference between the first pouch and the trap door is clearly desirable.

These concerns all are directed to the problems of increasing the speed of operation of such a bagging machine, while maintaining reliability. This is the objective of the invention described hereafter.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

In one aspect, a pouch bagging machine having a trap door and a pinching surface for engaging the upper edge of a bag or sack therebetween has such pinching surface mounted on a resiliently journaled cylindrical surface. The pinching surface may be provided, preferably, by a pad having a multitude of extending, rubber-like fingers formed thereon. Upon release of the pouches by the opening of the trap door, the rotation of the cylindrical surface controls the release of the sack into which the pouches fall.

According to another feature of the invention, the foremost edge of the next sack to be filled is displaced into the path of the trap door by exposing the adjacent sack surface directly above the foremost edge to a jet of air, delivered in a discrete, controlled quantity. The quantity of air delivered is preferably that required to extend the bag into an opened state without causing a substantial reverse flow of air out of the bag to occur. Conveniently, air may be provided from multiple orifices positioned along an air tube that is located above and proximate to the edge of the sack which is to be displaced.

According to a further feature of the invention, the sacks to be filled are hung on a pair of rods piercing a pair of holes formed in an upper extended panel located on one of the two upper ends of each sack, and the advancement of the sacks towards the trap door is encouraged by a gravity-activated pusher mounted on a hinge positioned above the next of said sacks to be filled. The pusher is provided with a cantilevered mass which is positioned outwardly from the last of said bags to be advanced, to provide a force which urges the sacks towards the trap door.

According to a further feature of the invention, the bagging machine is provided below the trap door with a deflector plate, positioned to carry a portion of the weight of the sack, as the pouches are being seated therein, and before the sack is torn from its upper retention means, and to deflect the sack as it falls into a conveyer positioned below.

According to another aspect of the invention, the vertical partition between the first and second sections of the hopper to be filled is rotatably displaceable by control means so as to restrain the first pouch on entering the hopper from descending as far as the trap door, and thereafter to release the first pouch so that it is in position to fall in synchronization with the second and third pouches when the trap door is opened.

The foregoing summarizes the principal features of the invention and some of its optional aspects. The invention may be further understood by the description of the preferred embodiments, in conjunction with the drawings, which now follow.

SUMMARY OF THE FIGURES

In FIG. 1 an infeed conveyor 1 carries pouches 2 to a hopper 3 from which they are inserted, in threes, into sacks 4 and then dropped onto an outflow conveyor 5 for further processing.

As seen in FIG. 2 pouches 2 on approaching the hopper 3 slide over a first or entry chute **6*a* to occupy one of three sections or compartments 7*a,b,c,* within the hopper 3. The first and second sections 7*a,b* are accessed by intermediate hinged chutes 6*b*, 6*c* which can swing into a vertical orientation, or lie overlapping each other in the direction of arriving pouches 2. Chute-control cylinders 23, through linkages 8 (seen in FIG. 7) activate these chutes so as to allocate bags consecutively to be deposited in the first 7*a*, second 7*b* and third 7*c* compartments of the hopper 3**.

Figure 1:
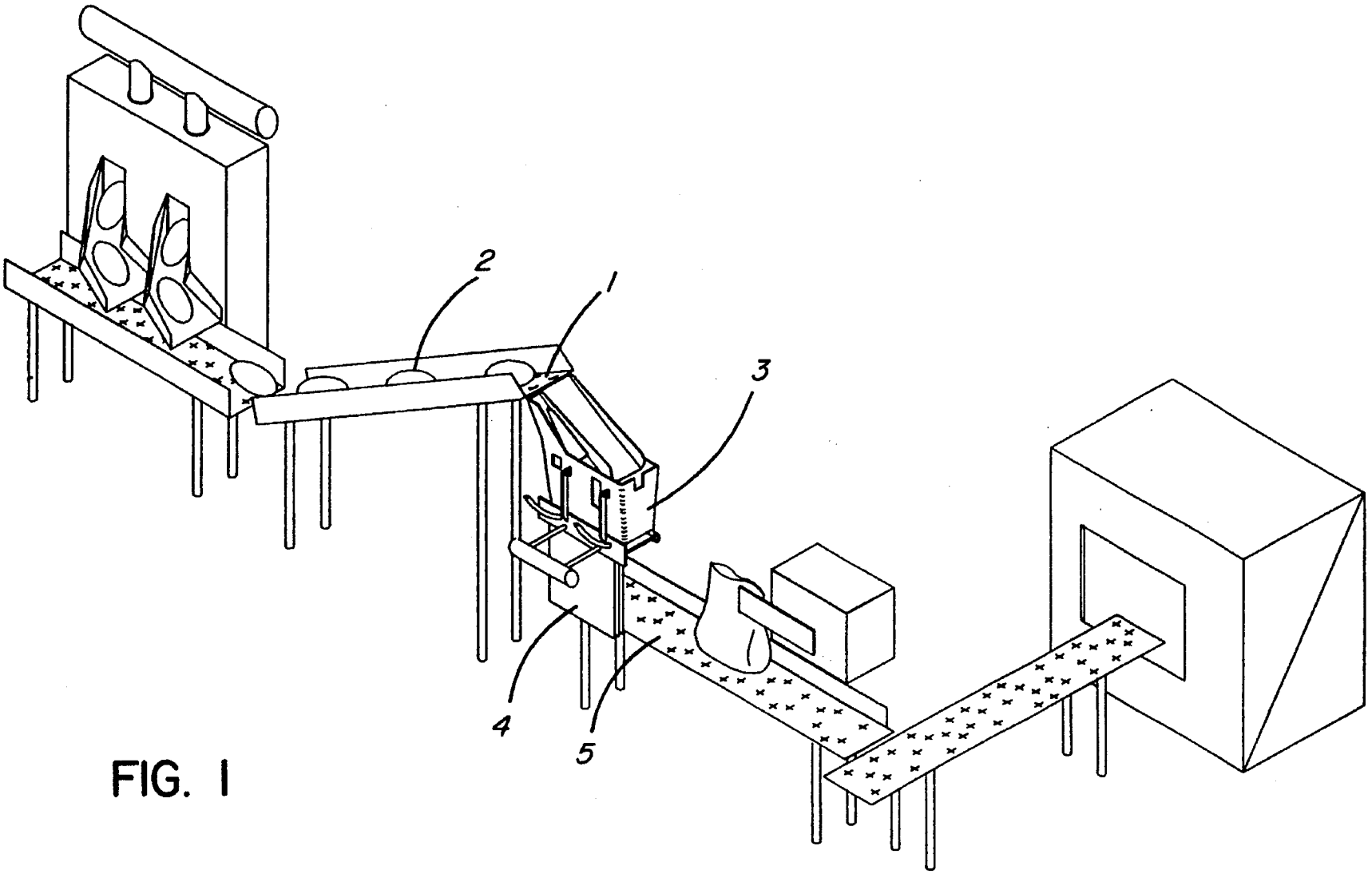
FIG. 1 is a perspective view of a bagging station of the type incorporating the invention.
Figure 2:
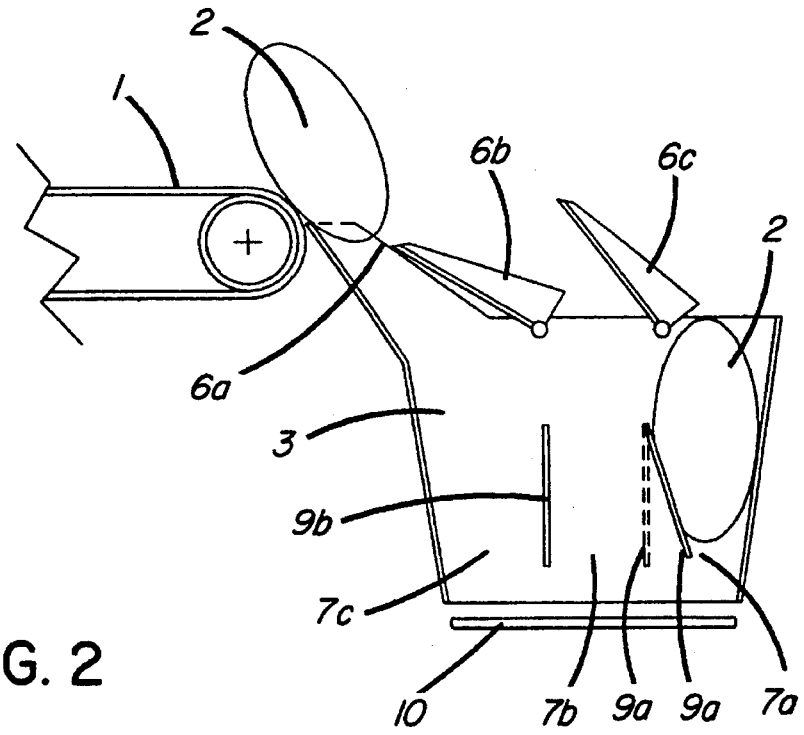
FIG. 2 is a frontal view cutaway cross-section of the hopper portion of the bagging station with a first pouch positioned therein.

Partitions **9*a* and 9*b* divide the first 7*a* and second 7*b* compartments, and second 7*b* and third 7*c* compartments respectively. While the last partition is fixed in a substantially vertical orientation the first partition 9*a* is hinged and controllable so that a partition control linkage 8 and partition cylinder 8*a* may rotate it from a vertical orientation to an angled position which will limit the downward passage of a pouch 2. This is shown in FIG. 2 wherein the distortion of the pouch 2 bag caused by the angled orientation of the controllable partition 9*a*** is apparent.

After a time delay TD5 (seen in FIG. 8) times out, the controllable partition **9*a* is rotated to release the first pouch 2 and allow it to drop with the other pouches 2 on the opening of the trap door 10**.

Figure 3:
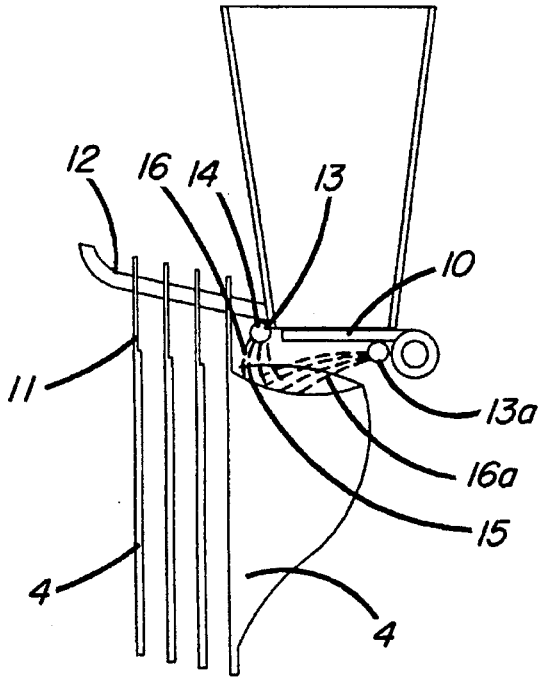
FIG. 3 is an end view cutaway cross-section of the hopper showing the sacks to be filled, with one sack being opened by the air jets.

The trap door 10 is shown in FIG. 3 in a closed condition, awaiting the filling of the hopper 3. Sacks 4 to be filled are stacked up in a flattened state hanging from upper end panels 11 on support rods 12 that pierce holes in such panels 11.

A conventional air duct **13*a* mounted on the trap door 10 provides a steady flow of air 16*a* at the appropriate time to break the seal to open the upper sack 4. An additional air duct 13 having multiple outlets 14 lies positioned along the upper foremost edge 15 of the leading sack 4. Air 16 from the duct 13 is directed towards the upper end panel 11 of the second half of the leading sack 4. While the outlet 16*a* provides a modest, steady flow of air, the additional duct 16 at the appropriate moment, releases a discrete burst of air 16** in order to fully snap open the leading sack 4. This pulse, from a 60 psi source, need only last 5/100's of a second.

The quantity of air should be sufficient to inflate the sack 4 into an open state, as shown in FIG. 3, sufficient to move the foremost edge 15 of the sack 4 to be displaced into the path of the trap door 10 as the door 10 it commences to open. The volume of air 16 should not be so much in excess as to cause undue turbulence from air flowing out of the sack 4.

In the prior art a continuous flow of air only has been employed. If this is excessive, it results in turbulent outflow. If a reduced or limited rate of flow of air is employed, this has the effect of limiting the speed of reliable operation. The use of a pulse of air allows high speed operation of the system with improved reliability.

Figure 4:
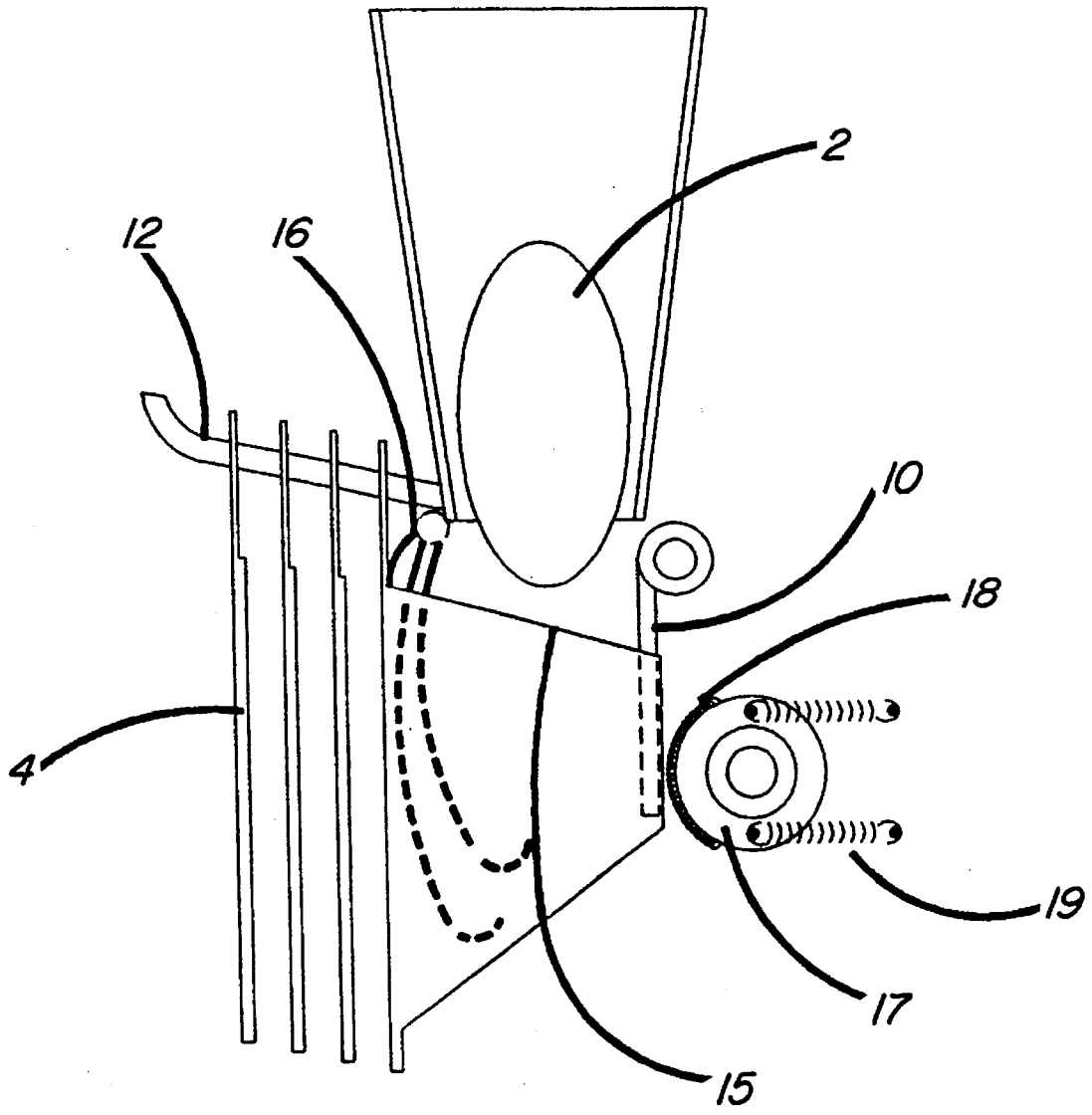
FIG. 4 shows a cutaway cross-sectional end view of the hopper with the trap door pinching a sack edge against the pinch roller.

As shown in FIG. 4, the opening trap door 10 carries the foremost edge 15 of the sack 4 with it until this edge 15 is pinched against a pinch roller 17. This roller 17 has a rubber texturized, high-friction surface that helps retain the bag in a pinched state. Preferably, this covering has numerous protruding fingers 18 that enhance this gripping effect.

The roller 17 is held in a neutral force rotating position by two springs 19 having a zero or soft initial spring schedule and is hollow so as to minimize its weight. These two features combine to minimize the initial force required to rotate the roller 17 and this force greatly increases as the rotation occurs. The effect of this is to prevent the tearing of sacks 4 when it is pinched between door 10 and roller 17 by dissipating the initial force of the filling of sacks 4 with pouches 2 by the resilient resistance of the friction between the roller 17 and the rear face of the trap door 10. This improves significantly the retention and release of the sack 4 as it is receiving the pouches 2. It has been found that reliable bagging rates of 130 bags per minute can be achieved with this feature present.

The roller 17 may be oriented to apply slightly more pinching force to sack edge 15 at the upstream or hopper-entry end. This causes the sacks 4 to fall preferentially with the forward or downstream bottom corner striking the conveyor 5 first. This orients the filled sacks 4 on the conveyor 5 more reliably.

Figure 5:
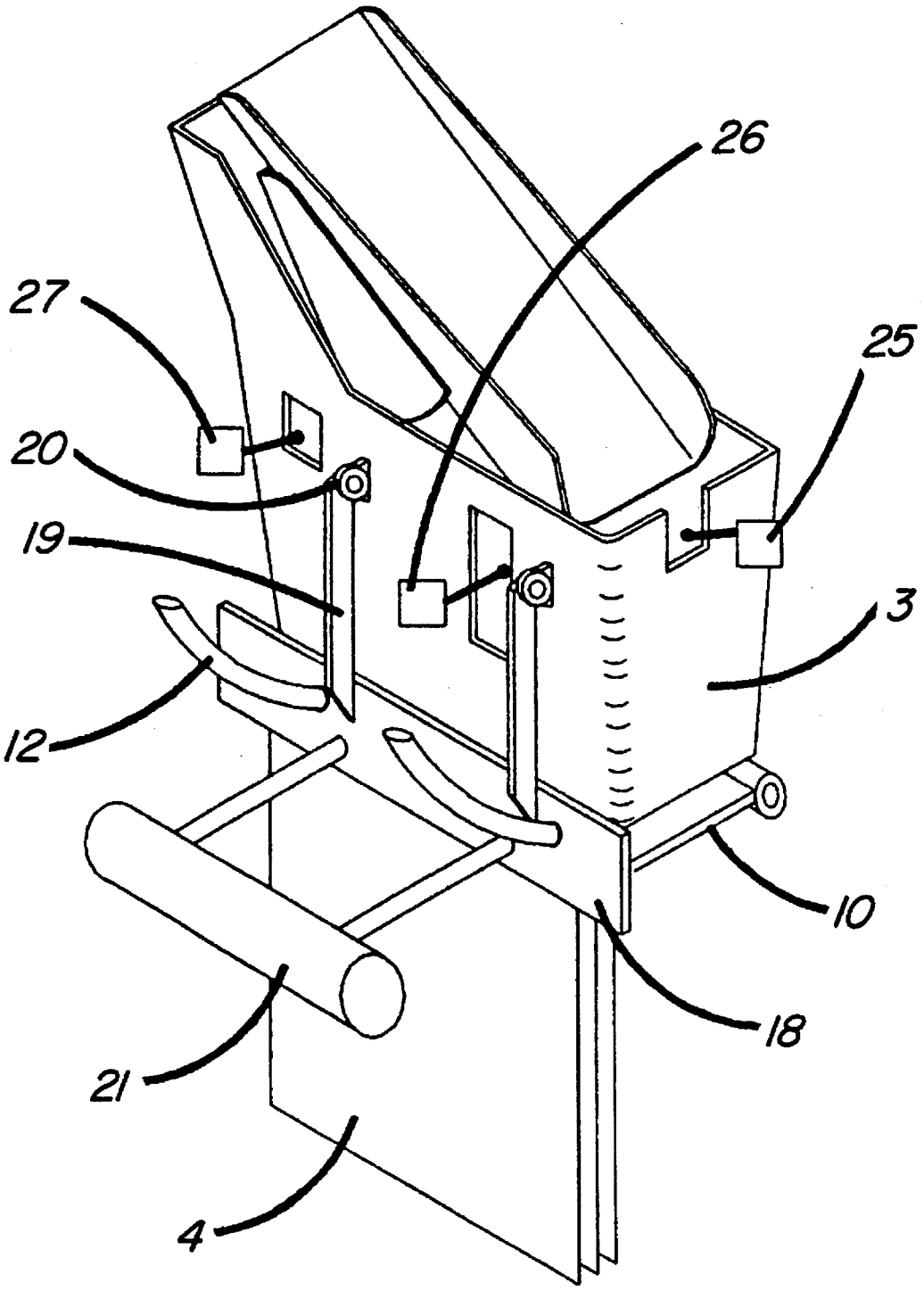
FIG. 5 is a perspective view of the bag-feed system.

The sacks 4 are fed into position adjacent the trap door 10 by their advancement along the rods 12. This advancement is effected by a pushing system, best seen in FIGS. 5 and 6, that includes a pusher plate 18 suspended by shafts 19 from a hinge 20 located above the foremost sack 4. A cantilevered weight 21 is attached to the pushing system so that the weight 21 is located outwardly from the last bag to be advanced towards the hopper 3. The rods 12 pass freely through holes in the pusher plate 18 as the plate 18 is swung about the hinges 20.

The cantilevered location of the weight 21, combined with the location of the hinge 20, allows gravity to provide an appropriate advancing force to the sacks 4. As sacks 4 are torn away, their upper panels 11 accumulate on the rods 12 against a stop (not shown), and the pusher plate 18 moves the leading edge 15 of the next sack 4 into position. The accumulating upper panels 11 prevent the pushing system from over-advancing the sacks 4.

When the rods 12 are fully loaded with sacks 4, a greater force is required to push them against the hopper 3. This force requirement decreases as the sacks 4 are consumed. Since the pushing system is hinged against the hopper 3 at hinge 20, the resulting force against the sacks 4 decreases as the sacks 4 are consumed.

It has been found that a 4.5 pound weight positioned outwardly from a 1.7 pound pusher plate 18 at a distance of 5½ inches, combined with a 8½ inch distance between the hinge 20 and cantilevered weight junction on the pusher plate 18 works very satisfactorily. The outer weight 21 may conveniently be in the form of a handle for elevation of the pusher system to clear the rods 12 when further sacks 4 are to be installed on the rods 12, as shown in FIG. 6.

Figure 6:
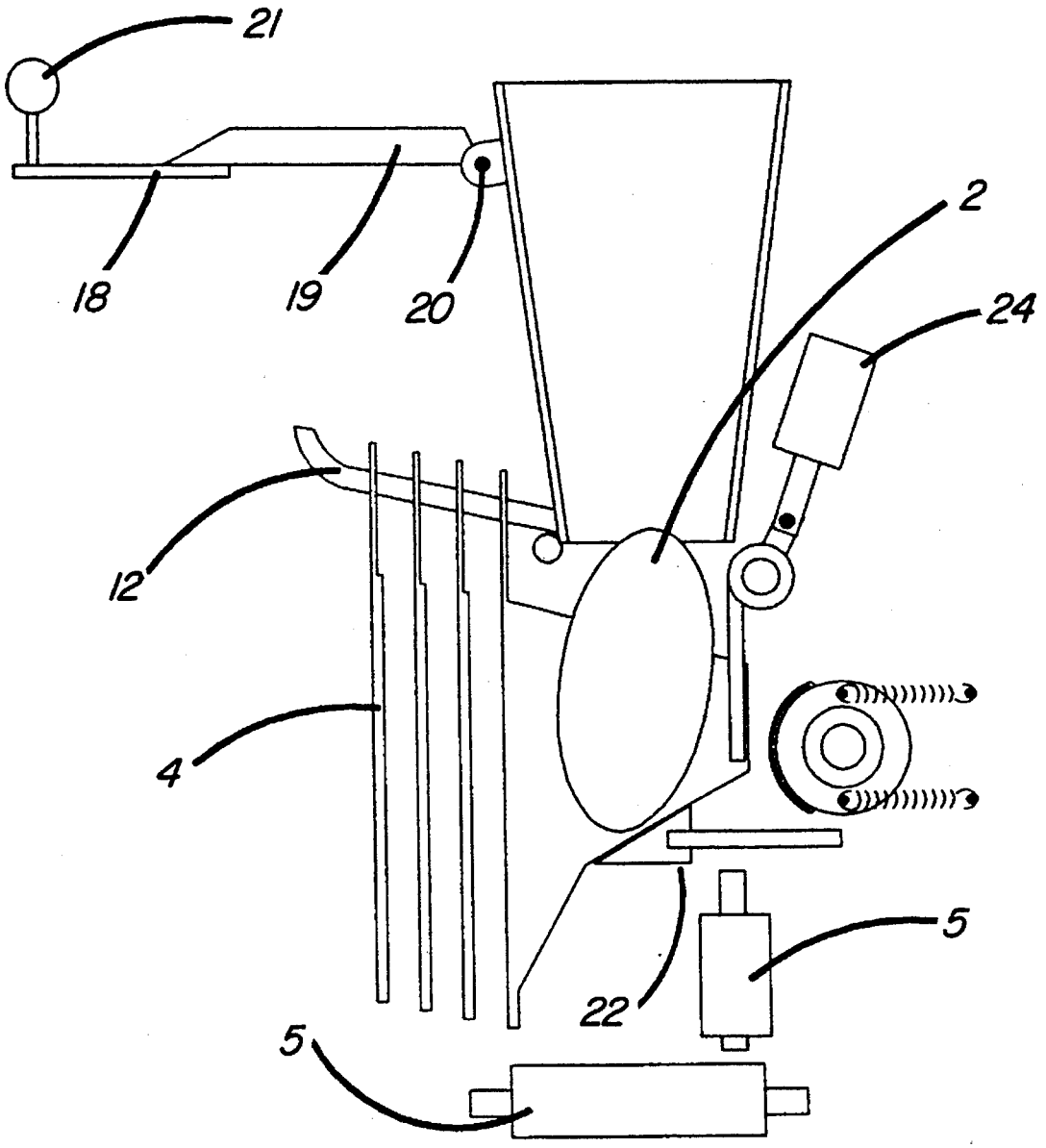
FIG. 6 shows a cross-sectional cutaway end view of the hopper with falling pouch contacting the deflector plate.

Returning to the fate of the sacks 4 when filled, FIG. 6 shows a sack 4 striking a deflector 22 placed beneath the hopper 3. This deflector 22 is positioned to take part of the weight of the pouches 2 before the sack 4 tears away from the rods 12. This separation occurs as the sack 4, filled with three pouches 2 slides off of the deflector 22 onto the out-flow conveyors 5.

With the deflector 22 present, it has been found that the sacks 4 are more reliably deposited on the outflow conveyor 5 with a consistent orientation. This improves the reliability of further handling of the sacks 4 downstream.

Figure 7:
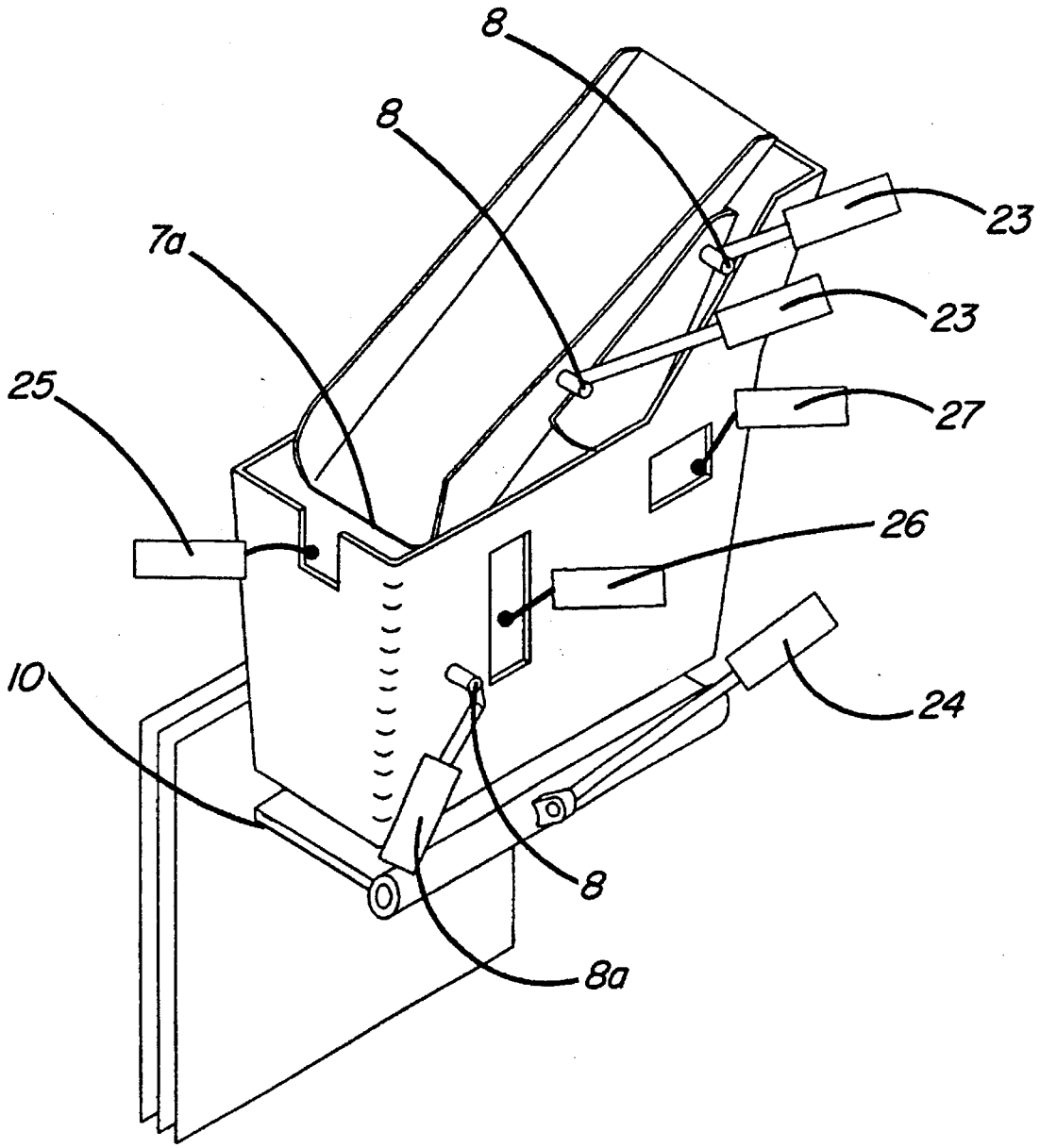
FIG. 7 shows a rear perspective view of the hopper with control linkages and sensing switches indicated.

In FIG. 7, the pneumatic cylinders 23 which control the positions of the chutes **6*b,c* and the cylinder 24 for the trap door 10 are shown. These cylinders 23,24, are activated by signals from an the pneumatic control system of FIG. 8** that receives input from a series of sensors.

A first sensor, in the form of a switch 25 which detects the presence of a sack 2 is positioned in the first compartment **7*a* to be occupied. Similar switch sensors 26,27 detect the presence of sacs in the second and third compartments 7*b,c***. The scheduling of events controlled by these switches is summarized in Table 1 wherein the events listed occur when the corresponding switch is "on".

TABLE 1

Timing of Action of Bagger Elements

| Time (seconds) | Switch 25 (on = detecting 1st pouch) | Switch 26 (on = detecting 2nd pouch) | Switch 27 (on = detecting 3rd pouch) |
|---|---|---|---|
| 0.00 | open the air jet 16a-steady flow elevate the chute 6c (FIG. 2) | | |
| 0.28 | after a timed delay (from 0.00 to 0.28 seconds) release the first partition 9a from an angled to a vertical orientation | | |
| 0.42 | | elevate the chute 6b (FIG. 2) release pulse of air 16 | |
| 0.90 | | | restore chutes to reclined position |
| 1.02 | | | open trap-door 10 |
| 1.12 | sensor 26 returns (by spring) descent of pouches 2 releases sensor 25 (approx.) | | sensor 27 returns (by spring) |
| 1.30 | | | after a timed delay (from 1.02 seconds to 1.30 seconds) close the trap-door 10 |
| 1.35 | after a timed delay (from 1.02 to 1.35) rotate the partition 9a to angled position | | |

TABLE 1-continued

| Timing of Action of Bagger Elements | | | |
|---|---|---|---|
| Time (seconds) | Switch 25 (on = detecting 1st pouch) | Switch 26 (on = detecting 2nd pouch) | Switch 27 (on = detecting 3rd pouch) |
| 1.46 | recommence cycle with arrival of first of next series of pouches 2. | | |

Table 1 is exemplary of the timing that may be employed to enhance the speed of operation of the system. Normal testing and calibration will determine the actual timing to be employed on a given set of hardware.

Figure 8:
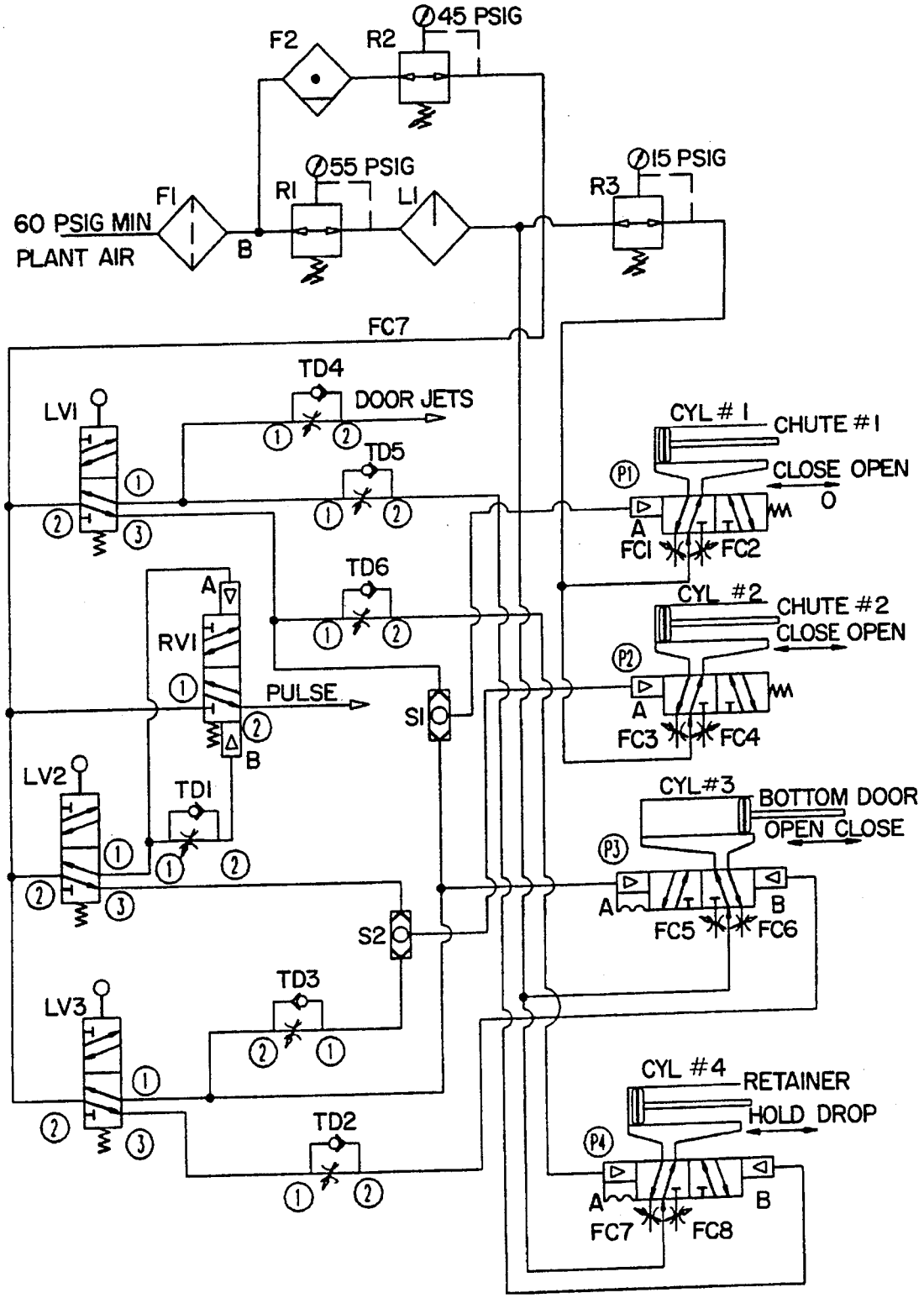
FIG. 8 is a schematic of the pneumatic control system for the invention.

FIG. 8 shows a schematic of a pneumatic control system for controlling the operation of the bagger. Plant air 30 enters at preferably over 60 psi. The functions of the components are listed in Table 2.

TABLE 2

| | |
|---|---|
| $F_1$ $F_2$ | filters |
| $R_1$ $R_2$ $R_3$ | regulators of air pressure |
| $L_1$ | Lubricator |
| RV1 | relay valve provides air for the pulse 16 |
| FC1, FC2 | flow control valves for the chute 6c clylinder 23 |
| FC3, FC4 | flow control valves for the chute 6b |
| FC5, FC6 | flow control valves for the trap door 10 |
| FC7, FC8 | flow control valves for rotating partition 9a |
| LV1 | limit valve (Sensor 25) controls flow of air to the door jets 16A and the chute 6c (cylinder 23) |
| TD1 | time delay for the duration of the pulse 16 |
| TD2 | time delay to control, the retention of the sack 4 by holding the trap door 10 open |
| TD3 | time delay (½ sec.) to allow for irregular pouch 2 release |
| TD4 | controls the air flow to the air jets acting as a flow control (not as a time delay) |
| TD5 | time delay to control the partition 9a to release the pouch 2. |
| TD6 | time delay to control the partition 9a to retain the next pouch 2 |
| S1, S2 | shuttle valves |
| LV2 | limit valve (Sensor 26) controls the flow of air to the pulse jet 16, the chute 6b |
| LV3 | limit valve (Sensor 27) provides air to the time delay valve TD2 to close the trap door 10, and recline the two chutes 6b and 6c. |
| P1 | power valve to control chute 6c |
| P2 | power valve to control chute 6b |
| P3 | power valve to control trap door 10 |
| P4 | power valve to control the partition 9a |

Conclusion

The foregoing has constituted a description of specific embodiments showing how the invention may be applied and put into use. These embodiments are only exemplary. For example, the number of compartments may vary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

We claim:

1. In an automatic bag filling machine for filling a plurality of plastic bags formed of two sheets bonded along their lower and side edges and provided with an upper end opening formed along an upper edge of the first of said two sheets, the second of such two sheets having an upwardly protruding, extension panel, for support of said bags in a vertically orientation, a bag-feeder mechanism comprising:

(a) support rods which carry a plurality of said bags in a flattened state by passing through holes formed in said extension panel to present such bags consecutively for filling by the machine; and (b) a gravity activated pusher mounted by a hinge positioned above the upper end of the first of said bags to be filled, such pusher comprising:

(i) suspension rods extending downwardly from the hinge to terminate at a contact plate which lies against the last of said bags to be filled; and (ii) a cantilevered mass supported at a distance displaced outwardly from the last of said bags and connected to said contact pipe, whereby the weight of such cantilevered mass applies a varying advancing force through the contact plates to the extension panels of said plurality of bags to advance said panels along the support rods, and wherein said contact plate is provided with holes passing therethrough, the support rods passing freely through such holes as the contact plate is swung about its hinges.

* * * * *